US005938536A

United States Patent [19]

Minke

[11] Patent Number: 5,938,536

[45] Date of Patent: Aug. 17, 1999

[54] INTEGRAL LOW MAINTENANCE CUE TIP

[76] Inventor: Ronald C. Minke, 10920 Current Cove, Fort Wayne, Ind. 46845

[21] Appl. No.: 08/868,304

[22] Filed: Jun. 3, 1997

[51] Int. Cl.[6] ..... A63D 15/12

[52] U.S. Cl. ..... 473/49

[58] Field of Search ..... 473/49, 50, 51, 473/44

[56] References Cited

U.S. PATENT DOCUMENTS

| | | | |
|---|---|---|---|
| 432,330 | 7/1890 | Rausch | 473/49 |
| 655,990 | 8/1900 | Prince | 473/51 |
| 1,532,985 | 4/1925 | Bradley . | |
| 1,558,740 | 10/1925 | Mallory . | |
| 1,620,595 | 3/1927 | Dilley et al. . | |
| 1,763,612 | 6/1930 | Crookston | 473/49 |
| 2,544,970 | 3/1951 | Watson . | |
| 3,381,960 | 5/1968 | Reinhart | 473/51 |
| 3,410,557 | 11/1968 | Stanley | 473/51 |
| 3,580,576 | 5/1971 | Merola . | |
| 3,598,409 | 8/1971 | Nemerek . | |
| 3,695,611 | 10/1972 | Lower | 473/51 |
| 5,016,877 | 5/1991 | Lowery | 473/51 |
| 5,462,490 | 10/1995 | Donwen . | |
| 5,725,437 | 3/1998 | McCarty | 473/49 |

OTHER PUBLICATIONS

Pocket Billiard Guidebook for Pool Players, Tournament Directors, and Spectators; James R. Lawson, Edt.; 1993; pp. 85–90.

Handbook of Plastic Compounds, Elastomers, and Resins; Michael and Irene Ash (1992) pages 56, 589–602.

*Primary Examiner*—Theatrice Brown

*Attorney, Agent, or Firm*—Paul W. O'Malley; Susan L. Firestone

[57] ABSTRACT

A cue tip is provided from a polyurethane elastomer having a hardness between Shore A 60 to Shore D 50. The cue tip has a hemispherically shaped striking surface having a diameter of between 7.0 and 15 millimeters and exhibiting a high coefficient of friction with billiard balls in an unchalked condition.

11 Claims, 2 Drawing Sheets

INTEGRAL LOW MAINTENANCE CUE TIP

BACKGROUND OF THE INVENTION

1. Field of the Invention

The present invention relates to an improved billiard cue and more particularly to an integral or one piece cue tip exhibiting high durability, a high coefficient of friction on the surface contacting the billiard cue ball and good rigidity.

2. Background to the Invention

The cue or cue stick used for billiards is a multiple part instrument used to make carom or pocket billiard shots. These shots may require power or delicacy, and may be made off center on the cue ball to impart back, left or right spin to the cue ball. The combinations of weight and balance of a cue, the materials from which the cue is made, and the manner in which the parts, e.g. ferrule, cue tip, shaft and butt (if a jointed cue) are connected, vary and strongly influence the ability of players to make shots. However, even the best quality cue cannot compensate for a badly worn cue tip.

Cue tips are pieces of shaped material attached to the cue end used to strike the cue ball. Generally, cue tips have been a piece of specially processed leather or other fibrous or pliable material. A cue tip made from relatively pliable material requires a player to make firmer shots to obtain a desired cue ball speed. However, pliable material compresses on contact with the cue ball, increasing the surface area in contact with the cue ball allowing more spin, draw or follow to be applied to the ball than a firm, less pliable tip allows. Additionally, a pliable tip holds chalk better than does a less pliable tip, and chalk increases the coefficient of friction between the cue tip and the ball, which aids in applying spin, draw and follow to the ball. Unfortunately, highly pliable cue tips deteriorate and lose their shape more quickly than firm cue tips, and their playing characteristics degrade more quickly as a result. Traditional tip materials rapidly deform and "mushroom" after only a few hundred impacts, necessitating reshaping of the cue tip.

The shape of the cue tip is important. The portion of the surface of the cue tip intended for contact with the cue ball is initially shaped as a hemisphere, ideally with a radius of between 8 mm and 14 mm. Generally, the larger the radius of the contact surface of the cue tip, the greater the surface area available for application to the cue ball, enhancing application of spin, draw and follow to the cue ball. A smaller radius tip reduces the chance of a miscue. However, a smaller radius tip implies a smaller radius shaft and such shafts lack stiffness. This in turn limits reduction of the shaft radius and, implicity, the tip radius if the tip is to remain flush with the the shaft. As discussed above, the durability of the cue tip contributes directly to how long the tip maintains a hemispherical shape within the desired dimensions. Smaller diameter cue tips have been considered more durable.

To maintain a cue tip with a proper hemispherical shape and pliability has required regular attention to the condition of the tip. In commercial establishments, cues frequently exhibit badly worn cue tips, making play more difficult. The need to constantly chalk cue tips also demands the proprietor's careful attention to the condition of chalk blocks. The proper maintenance of a leather faced cue tip can require labor in removal, gluing and shaping, typically done in professional shops at some expense.

Alternative materials to natural leather have been considered and the rules of play for pocket billiards specify only that leather and synthetic leather tips be used for jump shots.

Of particular interest is U.S. Pat. No. 5,016,877 to Lowery which teaches the use of polyurethane for cue tips. However, it is possible that several hundred types of polyurethane have been formulated for various functional attributes. The primary types of polyurethane have been generally categorized as coatings, foams, fibers and elastomers. Lowery identified three examples of material deemed suitable as a substitute for leather as cue tip material: Adiprene and Vibrathane, made by Uniroyal Chemical Company; and Mobay 4210, then made by Mobay Chemical Company (at the time of this writing Texin 4210, a product of Bayer Inc., Polymers Division, Pittsburgh, Penn.)

Adiprene and Vibrathane polyurethane are families of polyurethane elastomer products. Polyurethane elastomers are known for their resistance to abrasion, and are commonly used for shoe uppers and heels, encapsulation for electronic parts and automobile bumpers, among other applications. Texin 4210 is a polyurethane/polycarbonate blend thermoplastic. Lowery, while not specifying a particular version of Adiprene or Vibrathane for use, concluded that an appropriate polyurethane material for a cue tip would have a hardness of "from 55 to 85 Shore-D". The patent does not, however, discuss an appropriate coefficient of friction for the material nor does it discuss material resilience, that is the ability of the material to resume its original shape after deformation. Instead Lowery provided shaping of the cue tip, including a plurality of radial and parallel annular grooves to increase the area of contact between ball and cue tip upon tip and ball impact and tip deformation, thereby providing control when striking a ball obliquely.

SUMMARY OF THE INVENTION

It is an object of the present invention to provide an easily fabricated, low maintenance polyurethane cue tip for billiard cues. The invention comprises a cue tip having a substantially hemispherical surface for striking billiard balls provided by a polyurethane elastomer having a Shore hardness of 60-durometer A to 50-durometer D, and exhibiting a high coefficient of friction with billiard balls in an unchalked condition.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood with reference to the following detailed description of an illustrative embodiment when read in conjunction with the accompanying drawings, wherein:

DETAILED DESCRIPTION OF THE INVENTION

Figure 1:
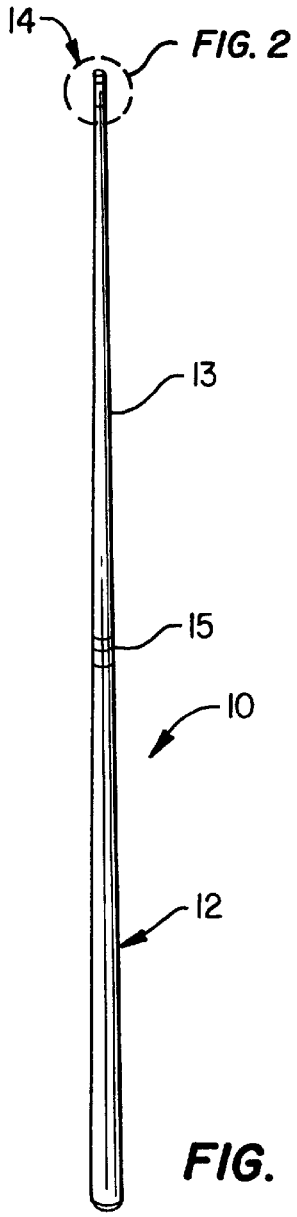
FIG. 1 illustrates a billiard cue fitted with a cue tip according to the invention.

FIG. 1 illustrates a billiard cue 10 comprising a butt 12 and a shaft 13, assembled at a joint 15. A tip section 14 is mounted at the narrower end of shaft 13. Alternatively, tip section 14 may be mounted on a billiard cue made of a one piece butt and shaft. The billiard cue, other than the tip section 14 is of conventional construction.

Figure 2:
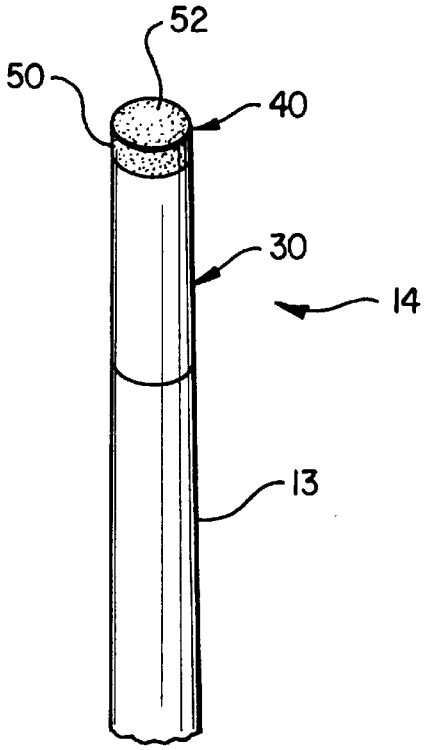
FIG. 2 is enlarged view of the cue tip of the billiard cue of FIG. 1.

Referring to FIG. 2, an assembled cue tip section 14 is illustrated in greater detail. Cue tip section 14 includes a ferrule 30, mounted to the narrow end of shaft 13 in a conventional manner. Ferrule 30 in turn supports a cue tip 40. Cue tip 40 has a cylindrical section 50 and a hemispherical surface 52 used for hitting balls. The preferred material for cue tip 40 is a polyurethane elastomer sold by Minnesota Mining and Manufacturing of Saint Paul, Minn. under the product name SJ-5302, which is part of the SJ-5300 series of polyurethane products. Generally, a preferred polyurethane is relatively hard, with the preferred Shore hardness values being between 60 durometer A and 50 durometer D (ASTM Standard D2240), is highly resilient, has an abrasion resistance of 0.13 g/1000 cycles (ASTM-C501-66), and, of particular importance, has a high coefficient of kinetic friction.

The SJ-5300 series of polyurethane products are formulated to exhibit unusually high coefficients of kinetic friction for polyurethane, and, for example, have published coefficients of kinetic friction of 2.2 with stainless steel and 1.0 with countertop type high pressure laminate. The specific coefficients of friction between SJ-5300 series polyurethane copolymer and the materials used to make billiard balls is not known to this inventor, however, the following values have been determined for the indicated materials and clean polished glass, used as a proxy for billiard balls using ASTM standard D1894-87:

| Material | Coefficient of Kinetic Friction |
|---|---|
| Smooth leather | .588 |
| Rough leather | .529 |
| Rough, chalked leather | .588 |
| rough fiber cue tip | .529 |
| rough, chalked fiber | .706 |
| SJ-5302 polyurethane tip Shore 60-A | 1.24 |
| Polyurethane tip Shore 85-A | 1.00 |
| Polyurethane tip Shore 60-D | .33 |
| Roughened, chalked urethane Shore 60-D | .602 |
| polyurethane tip Shore 50-D | .451 |

Within most polymer families, including urethane, hardness varies in an approximately inverse relationship with resilience and the coefficients of kinetic and static friction. Other polymer families having similar coefficients of friction at the appropriate hardness levels can be expected to work as well as SJ-5300 polyurethanes.

Good spin and low miscue frequency of struck cue balls has been obtained using unchalked cue tips made of polyurethane having a hemispherical surface 52 diameter of between 7.0 mm and 15.0 mm, with the preferred range being 10 to 13 mm, a hardness of between 60 durometer A and 50 durometer D and coefficients of friction greater than 0.451. The present inventor believes that most players would find smooth cue tips made of a material having a Shore hardness greater than 50-D uncomfortable to use.

Figure 3:
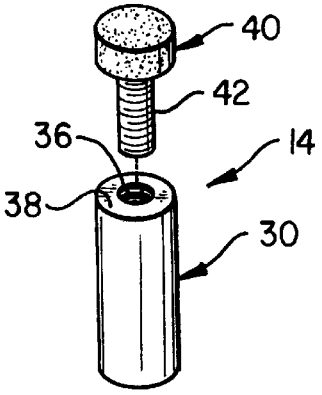
FIG. 3 is an exploded view of a first embodiment of the invention.

FIG. 3 is an exploded view of a low maintenance cost cue tip 14 illustrating assembly of the cue tip on a ferrule 30. A threaded member 42 extends from cue tip 40 for insertion into a cooperating threaded cylindrical passage 36 in ferrule 36. Passage 36 is centered in ferrule end 38 to fix the position of cue tip 40. Cue tip 40 may be molded as a piece or cut to shape.

Figure 4:
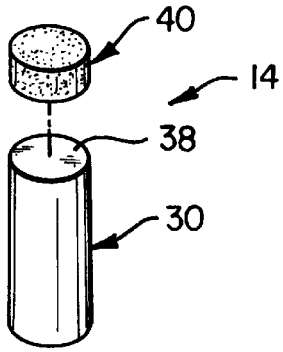
FIG. 4 is an exploded view of a second embodiment of the invention.

FIG. 4 illustrates use of the cue tip 40 of the present invention applied conventionally to a ferrule 30 by gluing the cue tip to ferrule end 38.

Figure 5:
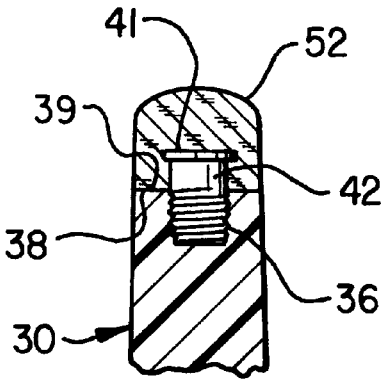
FIG. 5 is a cross sectional view of the first embodiment of the invention.

FIG. 5 is a cross sectional view of the tip section 14 of FIG. 3. Threaded member 42 is provided by a screw embedded in a cavity 41 in cue tip 40. When threaded tightly into passage 36, ferrule end 38 and a bottom face 39 of cue tip 40 are tightly pressed together making the joint between ferrule 30 and cue tip 40 flush.

Figure 6:
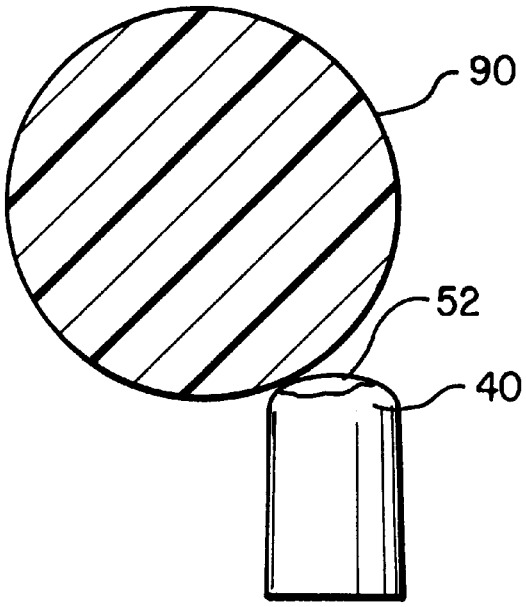
FIG. 6 is a cross-sectional view of a cue tip and billiard ball illustrating oblique contact between the two.

FIG. 6 illustrates off center contact between a cue ball 90 and hemispherical surface 52 of cute tip 40, as occurs when the cue ball is struck to impart spin. It is assumed that since a cue ball 90 cannot accelerate instantaneously when struck, applying spin to cue ball 90 by striking it off center with cue tip 40 occurs with the tip sliding against the ball surface. Accordingly, coefficients of kinetic friction have been used in qualifying polyurethane materials for use as tip material. However, it is possible that spin is applied to cue ball 90 concurrent with deformation of the tip 40, and that the tip itself is not sliding with respect to the surface of the cue ball. In this case the dynamics of the interaction between cue ball 90 and tip 40 would be more accurately described using coefficients of static friction. An accurate determination of the behavior of the dynamic system is not felt to be required for qualifying material given that the results have been favorable, as described above. The coefficient of kinetic friction between a polymer and clean, polished glass is believed an adequate proxy for the whichever coefficient of friction more accurately describes the actual interaction between cue tip and cue ball.

Figure 7:
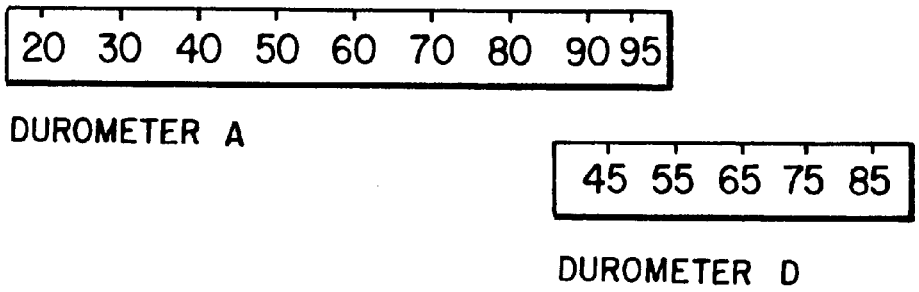
FIG. 7 is a chart comparing durometer A and durometer D Shore hardness scales.

FIG. 7 is a graph illustrating the overlap in range between the durometer A and durometer D hardness scales.

The present invention advantageously provides a highly durable cue tip for billiard cues which provides good control over shots without requiring chalking or careful attention to the condition of the cue tip.

While the invention is shown in only two of its forms, it is not thus limited but is susceptible to various changes and modifications without departing from the spirit and scope of the invention.

What is claimed is:

1. A cue tip for a billiard cue, comprising:

a substantially hemispherical surface for contacting billiard balls provided by a polymer having a Shore hardness between 60-A and 50-D and having a high coefficient of friction with respect to billiard balls.

2. A cue tip as specified in claim 1 wherein the polymer has a coefficient of kinetic friction with respect to clean polished glass of at least about 0.451.

3. A cue tip as specified in claim 2 wherein the diameter of the substantially hemispherical surface is between 7.0 millimeters and 15.0 millimeters, inclusive.

4. A cue tip as specified in claim 2 wherein the polymer is a polyurethane elastomer.

5. A cue tip as specified in claim 4 wherein the polyurethane elastomer is an SJ-5300 series polyurethane.

6. A cue tip as specified in claim 1 wherein the cue tip is a shaped piece of the polyurethane elastomer.

7. A cue tip as specified in claim 1 wherein the hemispherical surface is a polymer including a polyurethane elastomer.

8. A billiard cue comprising:

a cue tip having a striking surface made of a polymer with an approximate Shore hardness of between 60-A and 50-D and exhibiting a high coefficient of kinetic friction with respect to clean, polished glass;

a ferrule supporting the cue tip at one end of the billiard cue;

a shaft; and a butt.

9. A billiard cue as set forth in claim 8, wherein the shaft and butt are made of one piece.

10. A billiard cue as set forth in claim 8, wherein the striking surface of the cue tip is substantially hemispherical and has a diameter of between 7.0 and 15.0 millimeters, inclusive.

11. A billiard cue as specified in claim 8 wherein the cue tip is a shaped piece of the polyurethane elastomer having a coefficient of kinetic friction with respect to clean, polished glass of at least about 0.451.

* * * * *